US009038203B2

(12) United States Patent
Curtis

(10) Patent No.: US 9,038,203 B2
(45) Date of Patent: May 26, 2015

(54) PROTECTIVE GARMENT WITH VENT FEATURES

(75) Inventor: Nicholas J. Curtis, Liberty Township, OH (US)

(73) Assignee: Lion Group, Inc., Dayton, OH (US)

( * ) Notice: Subject to any disclaimer, the term of this patent is extended or adjusted under 35 U.S.C. 154(b) by 84 days.

(21) Appl. No.: 13/564,861

(22) Filed: Aug. 2, 2012

(65) Prior Publication Data

US 2013/0031703 A1 Feb. 7, 2013

Related U.S. Application Data

(60) Provisional application No. 61/514,245, filed on Aug. 2, 2011.

(51) Int. Cl.

| | |
|---|---|
| ***A62B 17/00*** | (2006.01) |
| ***A41D 27/28*** | (2006.01) |
| ***A41D 31/00*** | (2006.01) |
| ***A41B 7/06*** | (2006.01) |
| *A62B 5/00* | (2006.01) |

(52) U.S. Cl.

CPC ..... *A41D 31/0027* (2013.01); *A41B 7/06* (2013.01); *A62B 17/003* (2013.01); *A41D 2400/20* (2013.01); *A41D 2400/62* (2013.01)

(58) Field of Classification Search

CPC .... A62B 17/003; A62B 17/006; A62B 17/00; A62B 17/001; A62B 17/005; A62B 5/00; A62B 35/0025; A41D 31/0027; A41D 27/28; A41D 13/00; A41D 3/02; A41D 31/0022; A41D 2400/20; A41D 27/02

See application file for complete search history.

(56) References Cited

U.S. PATENT DOCUMENTS

| | | | | | |
|---|---|---|---|---|---|
| 2,079,980 | A | | 5/1937 | Anders | |
| 2,084,173 | A | | 6/1937 | Wexler | |
| 3,086,215 | A | | 4/1963 | Di Paola | |
| 3,153,793 | A | | 10/1964 | Lepore | |
| 3,921,224 | A | | 11/1975 | Ingram, III | |
| 4,408,356 | A | | 10/1983 | Abrams | |
| 4,513,451 | A | | 4/1985 | Brown | |
| 4,608,715 | A | | 9/1986 | Miller et al. | |
| 4,722,099 | A | * | 2/1988 | Kratz | 2/79 |
| 4,817,210 | A | * | 4/1989 | Aldridge et al. | 2/81 |
| 4,864,655 | A | * | 9/1989 | McKenney et al. | 2/93 |
| 5,031,242 | A | * | 7/1991 | Aldridge et al. | 2/81 |
| 5,090,057 | A | * | 2/1992 | Aldridge | 2/82 |
| 5,095,549 | A | * | 3/1992 | Aldridge | 2/304 |
| 5,127,106 | A | * | 7/1992 | Aldridge | 2/81 |
| 5,136,723 | A | * | 8/1992 | Aldridge et al. | 2/81 |
| 5,157,790 | A | * | 10/1992 | Aldridge | 2/227 |
| 5,168,582 | A | * | 12/1992 | Aldridge | 2/305 |
| 5,188,267 | A | * | 2/1993 | Sargent et al. | 2/95 |
| 5,219,367 | A | * | 6/1993 | Fields | 2/227 |
| 5,274,850 | A | * | 1/1994 | Aldridge | 2/84 |
| 5,351,340 | A | * | 10/1994 | Aldridge | 2/108 |

(Continued)

OTHER PUBLICATIONS

International Search Report and Written Opinion, PCT/US2012/049288 (Oct. 23, 2012).

*Primary Examiner* — Bobby Muromoto, Jr.

(74) *Attorney, Agent, or Firm* — Thompson Hine LLP

(57) ABSTRACT

A protective garment including a heat, flame and abrasion resistant outer shell configured to be worn on at least part of a body of a wearer, the outer shell including an opening formed therein. The garment further includes a heat and flame resistant material, of a different type of material than the outer shell, positioned in the opening.

26 Claims, 7 Drawing Sheets

(56) References Cited

U.S. PATENT DOCUMENTS

| | | | | | |
|---|---|---|---|---|---|
| 5,507,042 | A * | 4/1996 | van der Slessen | 2/69 |
| 5,539,928 | A * | 7/1996 | Aldridge | 2/93 |
| 5,640,718 | A * | 6/1997 | Aldridge | 2/81 |
| 5,685,015 | A * | 11/1997 | Aldridge | 2/81 |
| 5,697,101 | A * | 12/1997 | Aldridge | 2/81 |
| 5,701,606 | A * | 12/1997 | Aldridge | 2/81 |
| 5,704,064 | A * | 1/1998 | van der Sleesen | 2/69 |
| 5,720,045 | A * | 2/1998 | Aldridge | 2/81 |
| 5,724,673 | A * | 3/1998 | Aldridge | 2/81 |
| 5,752,277 | A | 5/1998 | van der Sleesen | |
| 5,819,316 | A * | 10/1998 | Aldridge | 2/81 |
| 5,920,905 | A * | 7/1999 | Aldridge | 2/81 |
| 5,924,134 | A * | 7/1999 | Taylor et al. | 2/81 |
| 5,933,865 | A * | 8/1999 | Aldridge | 2/81 |
| 5,983,409 | A * | 11/1999 | Aldridge et al. | 2/458 |
| 5,996,122 | A * | 12/1999 | Aldridge et al. | 2/81 |
| 6,009,560 | A * | 1/2000 | McKenney et al. | 2/244 |
| 6,038,700 | A * | 3/2000 | Aldridge et al. | 2/81 |
| 6,049,906 | A * | 4/2000 | Aldridge | 2/23 |
| 6,070,274 | A * | 6/2000 | van der Sleesen | 2/456 |
| 6,085,353 | A * | 7/2000 | van der Sleesen | 2/69 |
| 6,263,510 | B1 * | 7/2001 | Bay et al. | 2/93 |
| 6,430,754 | B1 * | 8/2002 | Taylor et al. | 2/458 |
| 6,442,760 | B2 | 9/2002 | Moretti | |
| 6,687,913 | B2 * | 2/2004 | Aldridge | 2/81 |
| 6,823,678 | B1 * | 11/2004 | Li | 62/3.5 |
| 6,845,517 | B2 * | 1/2005 | Aldridge et al. | 2/81 |
| 6,868,557 | B1 * | 3/2005 | van der Sleesen | 2/93 |
| 6,904,618 | B2 * | 6/2005 | Musal | 2/425 |
| 38,838 | A1 * | 2/2006 | Silverbrook | 2/115 |
| 7,043,766 | B1 * | 5/2006 | Foreman et al. | 2/81 |
| 7,043,767 | B2 | 5/2006 | Jaeger | |
| 7,124,593 | B2 * | 10/2006 | Feher | 62/3.5 |
| 7,168,103 | B2 * | 1/2007 | Aldridge et al. | 2/458 |
| 7,181,774 | B2 | 2/2007 | Silver | |
| 7,395,555 | B2 * | 7/2008 | Aldridge et al. | 2/69 |
| 7,913,322 | B2 * | 3/2011 | Aldridge | 2/81 |
| 7,958,569 | B2 * | 6/2011 | Razzaghi et al. | 2/62 |
| 7,996,920 | B2 * | 8/2011 | Aldridge | 2/69 |
| 8,332,963 | B2 * | 12/2012 | Razzaghi et al. | 2/62 |
| 8,522,368 | B2 * | 9/2013 | McIntosh et al. | 2/458 |
| 2003/0033656 | A1 | 2/2003 | Jaeger | |
| 2003/0192537 | A1 * | 10/2003 | Odell et al. | 128/201.22 |
| 2004/0154084 | A1 * | 8/2004 | Aldridge et al. | 2/458 |
| 2004/0250339 | A1 * | 12/2004 | Musal | 2/410 |
| 2005/0044607 | A1 * | 3/2005 | Sleesen | 2/93 |
| 2005/0066401 | A1 * | 3/2005 | Feher | 2/2.5 |
| 2006/0038838 | A1 | 1/2006 | Foreman et al. | |
| 2006/0282940 | A1 * | 12/2006 | Martini et al. | 2/455 |
| 2007/0094763 | A1 * | 5/2007 | Silver | 2/69 |
| 2008/0115252 | A1 | 5/2008 | Dahan | |
| 2008/0209611 | A1 * | 9/2008 | Tyrrell | 2/79 |
| 2008/0282443 | A1 * | 11/2008 | Curtis et al. | 2/81 |
| 2009/0077710 | A1 | 3/2009 | Bay | |
| 2009/0255029 | A1 * | 10/2009 | Aldridge | 2/81 |
| 2009/0255031 | A1 * | 10/2009 | McIntosh et al. | 2/87 |
| 2009/0255038 | A1 * | 10/2009 | Curtis | 2/455 |
| 2009/0320176 | A1 * | 12/2009 | Curtis | 2/81 |
| 2010/0095439 | A1 * | 4/2010 | Nolan et al. | 2/421 |
| 2011/0030118 | A1 * | 2/2011 | Pratchett | 2/81 |
| 2011/0047675 | A1 * | 3/2011 | Aldridge | 2/227 |
| 2011/0203039 | A1 * | 8/2011 | Razzaghi et al. | 2/458 |
| 2012/0174296 | A1 * | 7/2012 | Martin | 2/457 |
| 2012/0174298 | A1 * | 7/2012 | Bay | 2/459 |
| 2012/0233748 | A1 * | 9/2012 | Curtis | 2/455 |
| 2013/0031703 | A1 * | 2/2013 | Curtis | 2/455 |
| 2013/0212788 | A1 * | 8/2013 | Curtis et al. | 2/455 |
| 2013/0254969 | A1 * | 10/2013 | Getzen et al. | 2/108 |

* cited by examiner

PROTECTIVE GARMENT WITH VENT FEATURES

This application claims priority to U.S. Provisional Patent Application Ser. No. 61/514,245, filed on Aug. 2, 2011, the entire contents of which are hereby incorporated by reference.

The present invention relates to protective garments, and more particularly, to protective garments with vent features.

BACKGROUND

Protective or hazardous duty garments are widely used in various industries to protect the wearer from various hazardous conditions such as heat, smoke, cold, sharp objects, chemicals, liquids, fumes and the like. The protective garment may include an outer shell layer, a thermal barrier or thermal liner located inside the outer shell, and a moisture barrier located inside the outer shell. The moisture barrier may be made of semi-permeable material such that the moisture barrier is generally liquid impermeable and generally moisture vapor permeable.

The moisture barrier may be located inside the outer shell to block moisture from the ambient environment from passing through the garment, while allowing moisture vapor inside the garment to pass through the moisture barrier. However, although the moisture barrier may be generally permeable to moisture vapor to allow moisture vapor to pass therethrough, moisture vapor may still remain trapped inside the garment. In particular, under heavy work conditions the moisture vapor generated by the wearer (for example, by perspiration) may be generated at a rate greater than that which can pass through the moisture barrier.

In addition, wearers of protective garments may often carry heavy equipment, such as a self-contained breathing apparatus ("SCBA") tank or the like. Such equipment may be carried on the user's back, which can compress the garment and reduce its thermal protection at such areas of compression.

SUMMARY

In one embodiment, the present invention is a protective garment including a heat, flame and abrasion resistant outer shell configured to be worn on at least part of a body of a wearer, the outer shell including an opening formed therein. The garment further includes a heat and flame resistant material, of a different type of material than the outer shell, positioned in the opening.

DETAILED DESCRIPTION

Figure 1:
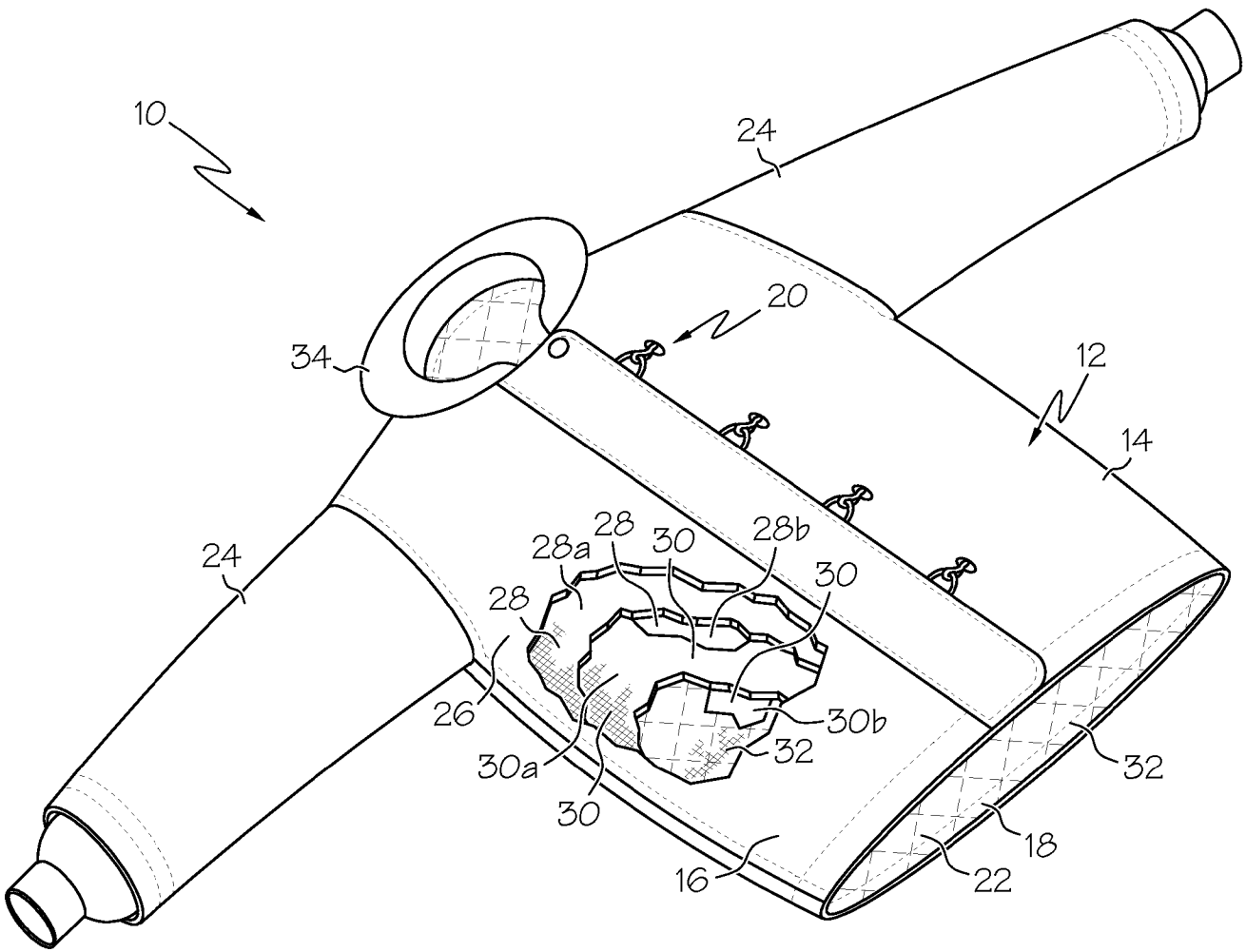
FIG. 1 is a front perspective view of one embodiment of the garment of the present invention, with portions of various layers cut away for illustrative purposes.

FIG. 1 illustrates a protective or hazardous duty garment in the form of a firefighter's coat, generally designated 10. The coat 10 may include a body portion 12 having a left front panel 14, right front panel 16 and a back panel 18. The left front panel 14 and right front panel 16 may be releasably attachable by a fastener 20, such as a zipper, snaps, clasps, clips, hook-and-loop fastening material (i.e., VELCRO® fastening material), combinations of these components or the like. The body portion 12 may define a torso cavity 22 that is shaped and configured to receive a wearer's torso therein. The garment 10 may include a pair of sleeves 24 coupled to and extending generally outwardly from the body portion 12 and shaped to receive a wearer's arms therein.

The garment 10 may include various layers through its thickness to provide various heat, moisture and abrasion resistant qualities to the garment 10 so that the garment 10 can be used as a protective, hazardous duty, and/or firefighter garment. For example, the garment 10 may include an outer shell 26, a moisture barrier 28 located inside of and adjacent to the outer shell 26, a thermal liner or barrier 30 located inside of and adjacent to the moisture barrier 28, and an inner liner or face cloth 32 located inside of and adjacent to the thermal barrier 30.

The outer shell 26 may be made of or include a variety of materials, including a flame, heat and abrasion resistant material such as a compact weave of aramid fibers and/or polybenzamidazole fibers. Commercially available aramid materials include NOMEX and KEVLAR fibers (both trademarks of E.I. DuPont de Nemours & Co., Inc. of Wilmington, Del.), and commercially available polybenzamidazole fibers include PBI fibers (a trademark of PBI Performance Fabrics of Charlotte, N.C.). Thus, the outer shell 26 may be an aramid material, a blend of aramid materials, a polybenzamidazole material, a blend of aramid and polybenzamidazole materials, or other appropriate materials. The outer shell 26 can also be made of a thermostable organic polymer material, such as KERMEL® material sold by Kermel SAS of Colmar, France.

If desired, the outer shell 26 may be coated with a polymer, such as a durable, water repellent finish (i.e. a perfluorohydrocarbon finish, such as TEFLON® finish sold by E. I. Du Pont de Nemours and Company of Wilmington, Del.). The materials of the outer shell 26 may have a weight of, for example, between about five and about ten oz./yd$^2$.

The moisture barrier 28 and thermal barrier 30 may be generally coextensive with the outer shell 26, or spaced slightly inwardly from the outer edges of the outer shell 26 (i.e., spaced slightly inwardly from the outer ends of the sleeves 24, the collar 34 and from the lower edge of the garment 10) to provide moisture and thermal protection throughout the garment 10. The moisture barrier 28 may include a semi-permeable membrane layer 28*a* and a substrate 28*b*.

The membrane layer 28*a* may be generally water vapor permeable but generally impermeable to liquid moisture. The membrane layer 28*a* may be made of or include expanded polytetrafluoroethylene ("PTFE") such as GORE-TEX or CROSSTECH materials (both of which are trademarks of W.L. Gore & Associates, Inc. of Newark, Del.), polyurethane-based materials, neoprene-based materials, cross-linked polymers, polyamid, or other materials. The membrane layer 28*a* may have microscopic openings that permit moisture vapor (such as water vapor) to pass therethrough, but block liquids (such as liquid water) from passing therethrough. The membrane layer 28*a* may be made of a microporous material that is either hydrophilic, hydrophobic, or somewhere in between. The membrane layer 28*a* may also be monolithic and may allow moisture vapor transmission therethrough by molecular diffusion. The membrane layer 28*a* may also be a combination of microporous and monolithic materials (known as a bicomponent moisture barrier), in which the microporous or monolithic materials are layered or intertwined.

The membrane layer 28*a* may be bonded or adhered to a substrate 28*b* of a flame and heat resistant material to provide structure and protection to the membrane layer 28*a*. The substrate 28*b* may be or include aramid fibers similar to the aramid fibers of the outer shell 26, but may be thinner and lighter in weight. The substrate 28*b* may be woven, non-woven, spunlace or other materials. In the illustrated embodiment, the membrane layer 28*a* is located between the outer shell 26 and the substrate 28*b*. However, the orientation of the moisture barrier 28 may be reversed such that the substrate 28*b* is located between the outer shell 26 and the membrane layer 28*a*.

The thermal barrier 30 may be made of nearly any suitable flame resistant material that provides sufficient thermal insulation. In one embodiment, the thermal barrier 30 may include a layer of bulk material 30*a* in the form of relatively thick (i.e. between about 1/16"-3/16") batting, felt or needled non-woven bulk or batting material. The bulk material 30*a* can include aramid fiber batting (such as NOMEX batting), aramid needlepunch material, an aramid non-woven material, an aramid blend needlepunch material, an aramid blend batting material, an aramid blend non-woven material, foam (either open cell or closed cell), or other suitably thermally insulating materials. The bulk material 30*a* may trap air and possess sufficient loft to provide thermal resistance to the garment 10.

The bulk material 30*a* may be quilted to a thermal barrier face cloth 30*b* which can be a weave of a lightweight aramid material. Thus, either the bulk material 30*a* alone, or the bulk material 30*a* in combination with the thermal barrier face cloth 30*b*, may be considered to constitute the thermal barrier 30. In the illustrated embodiment, the thermal barrier bulk material 30*a* is located between the outer shell 26 and the thermal barrier face cloth 30*b*. However, the orientation of the thermal barrier 30 may be reversed such that the face cloth 30*b* is located between the outer shell 26 and the bulk layer 30*a*. In one embodiment, the thermal barrier 30 (or the garment 10 as a whole) may have a thermal protection performance ("TPP") of at least about twenty, and the garment 10 as a whole may have a TPP of at least about thirty-five. If desired, the thermal barrier 30 may be treated with a water-resistant or water-repellent finish.

Although the moisture barrier 28 is shown as being located between the outer shell 26 and the thermal barrier 30, the positions of the moisture barrier 28 and thermal barrier 30 may be reversed such that the thermal barrier 30 is located between the outer shell 26 and the moisture barrier 28, or various other orientations or configurations may be used.

The face cloth 32 may be the innermost layer of the garment 10, located inside the thermal barrier 30 and moisture barrier 28. The face cloth 32 can provide a comfortable surface for the wearer and protect the thermal barrier 30 and/or moisture barrier 28 from abrasion and wear. The face cloth 32 may be quilted to the adjacent layer (i.e. the thermal barrier 30 in the illustrated embodiment). However, the face cloth 32 is optional and may be excluded if desired. In addition, the garment 10 may not necessarily include the moisture barrier 28 and/or the thermal barrier 30 in certain cases.

Each layer of the garment 10 disclosed herein, including the layers and components described above, as well as those described below, and the garment 10 as a whole, may meet the National Fire Protection Association ("NFPA") 1971 standards for protective firefighting garments ("Protective Clothing for Structural Firefighting"), which are entirely incorporated by reference herein. The NFPA standards specify various minimum requirements for heat and flame resistance and tear strength. For example, in order to meet the NFPA standards, the outer shell 26, moisture barrier 28, thermal barrier 30 and face cloth 32 must be able to resist igniting, burning, melting, dripping, separation, and/or shrinking more than 10% in any direction after being exposed to a temperature of 500° F. for at least five minutes. Furthermore, in order to meet the NFPA standards, the combined layers of the garment 10 must provide a thermal protective performance rating of at least thirty-five.

Alternately or in addition to the NFPA Standard 1971, the garment 10 disclosed herein may also meet European Norm ("EN") standards for firefighting garments set by the European Committee for Standardization (also known as Comité Européen de Normalisation ("CEN")). These standards include EN 469:2005 Level 1 and Level 2 certification. The EN standards for firefighter and protective garments are entirely incorporated by reference herein.

Figure 2:
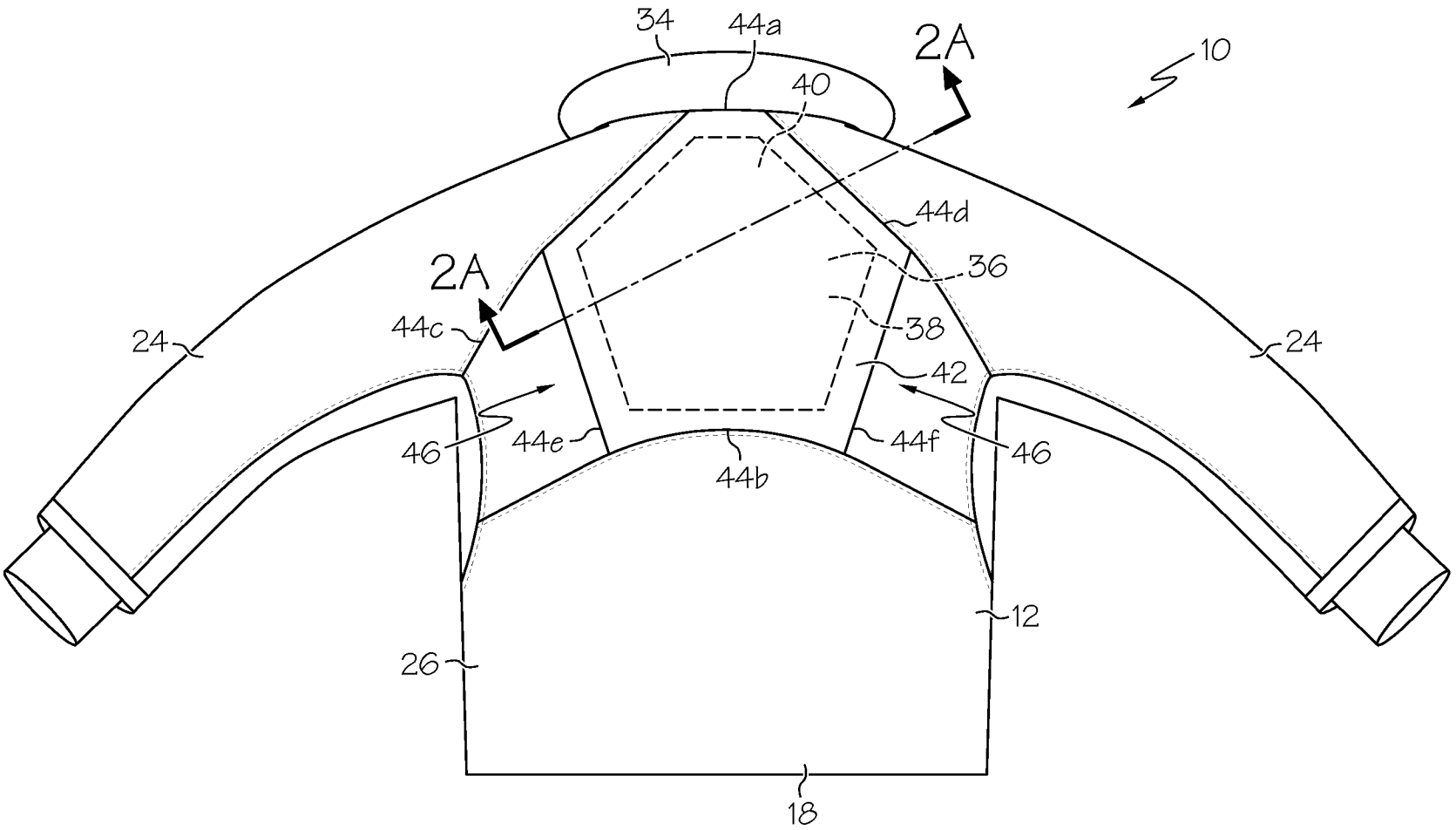
FIG. 2 is a back view of the garment of FIG. 1.
Figure 2A:
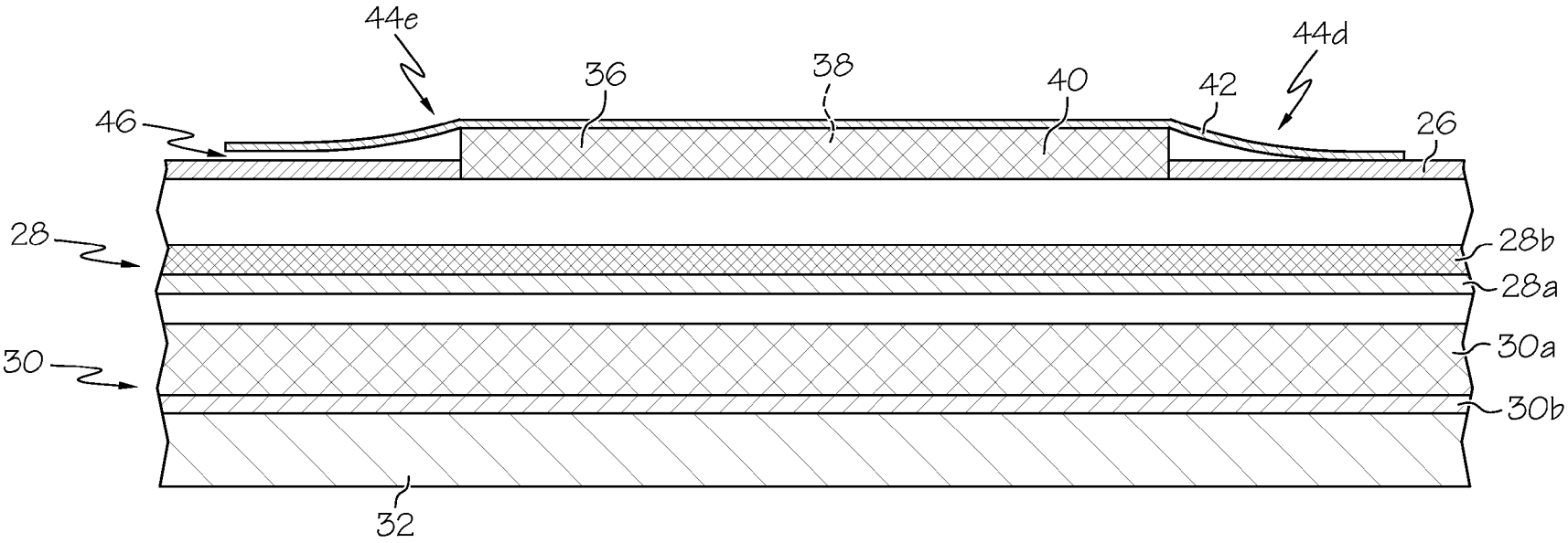
FIG. 2*a* is a side cross section, taken along line 2*a*-2*a* of FIG. 2.
Figure 3:
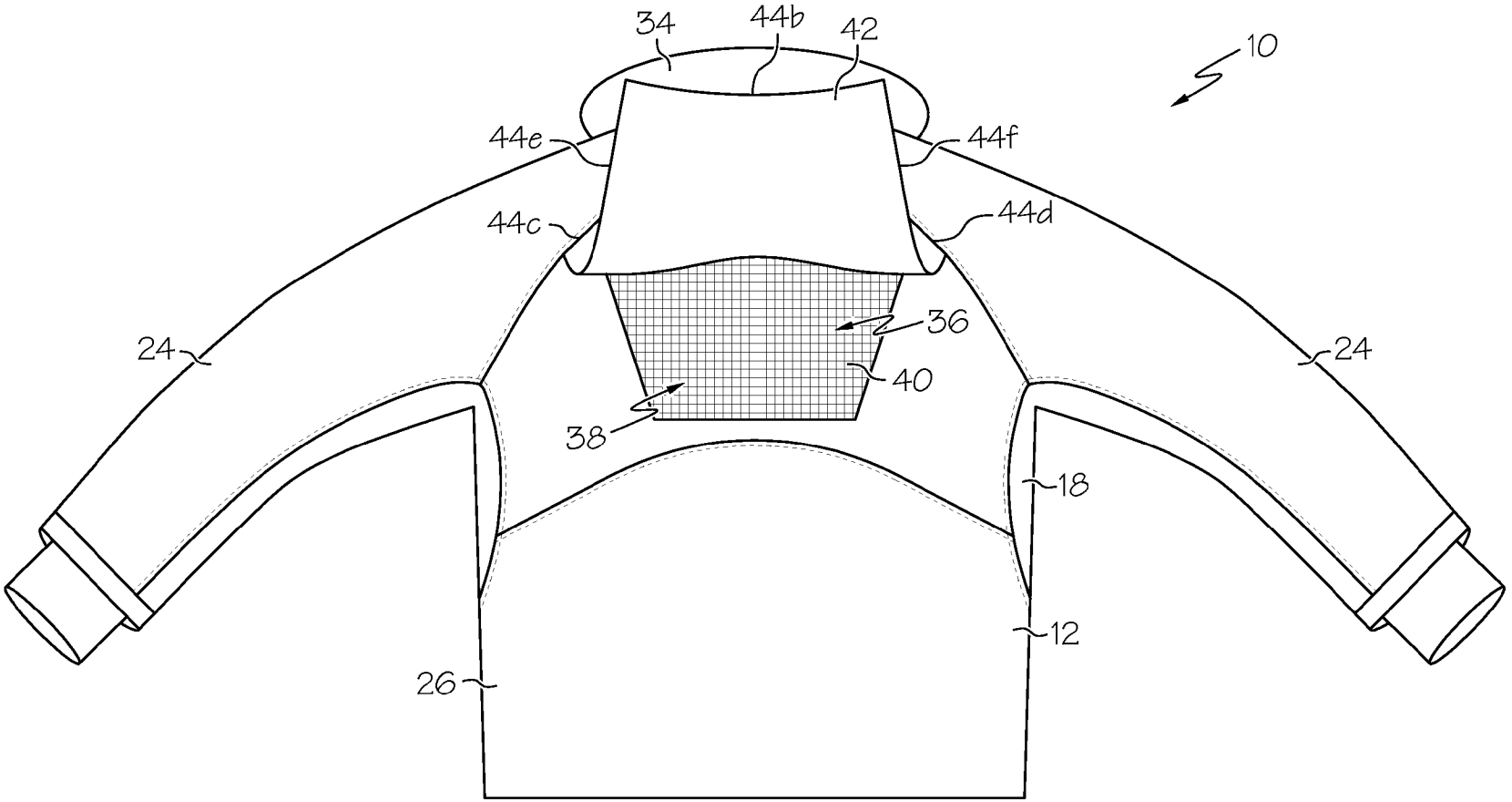
FIG. 3 is a back view of the garment of FIG. 2, with part of the protective flap folded upwardly for illustrative purposes.

As shown in FIGS. 2, 2*a* and 3, the garment 10 may include a vent 36 formed in the back panel 18 of the outer shell 26 of the garment 10. The vent 36 includes, or is at least partially defined by, an opening 38 formed in the back panel 18/outer shell 26. As best shown in FIGS. 2*a* and 3, in the illustrated embodiment the opening 38 is formed in the outer shell 26 of the garment 10. In other words, portions of the outer shell 26 are removed, or not present, in the area of the opening 38, exposing the layers (such as moisture barrier 28) below the outer shell 26 (although such "exposed" areas may be covered by a filler layer 40 as described below). The opening 38 can have any of a variety of sizes and shapes, but in one embodiment has a surface area of at least about 16 square inches, and in another embodiment at least about 36 square inches, to sufficiently provide the venting and cushioning benefits described below. In one case the outer shell 26 shell is generally flat and continuous, defining an outer shell plane, and the opening 38 is generally co-planar with the outer shell 26 such that the opening 38 provides a path into the interior of the outer shell 26 in a direction perpendicular to the outer shell plane.

A filler layer or material 40 may be positioned in the opening 38. In the illustrated embodiment the filler material 40 entirely fills and covers/spans the opening 38. The filler material 40 may be coupled to the outer shell 26 about the entire perimeter, or substantially the entire perimeter, of the filler material 40/opening 38. The filler material 40 may be generally co-planar with the outer shell 26, and may lack any portions that lie on top of, or overlap with, the outer shell 26. The filler material 40 can made of a low weight, flame-resistant, high thermal insulation material (i.e. having at least about the same thermal insulation properties as those of the thermal liner 30 described above), including but not limited to PEEK (Polyether ether ketone) or flame resistant meta-aramid material, such as NOMEX® material. The filler material 40 may be a knit material made with various knitted constructions, such as flat, circular, jersey, interlock, rib, mesh, power mesh, tricot, warp, fleece, terry or the like. The filler material 40 may be a layered or matrix material with an appreciable thickness such that the filler material 40 traps air therein to provide superior thermal insulating characteristics to the garment 10, and made of a different material than the rest of the outer shell 26 and/or moisture barrier 28 and/or thermal barrier 30.

The improved thermal insulation provided by the filler material 40 can be particularly useful since firefighters often carry SCBA tanks or the like on their backs. The weight provided by the SCBA tanks compress the backs of the garment 10, which reduces the thermal insulation of the garment 10 at the area of compression. Thus, the improved thermal insulation provided by the filler material 40 helps to offset the loss of insulation due to compression when carrying the SCBA tank. In addition, the filler material 40 can act as a cushion to protect the wearer's back from the SCBA tank or other equipment.

The filler material 40 may flush with, recessed relative to, or protrude outwardly relative to the surrounding outer shell 26 and may have a variety of thickness, such as at least about 1/16", or at least about 1/4" or less than about 1/2", or less than about 1", or between about 1/16" and about 1/2". The filler material 40 should be sufficiently thick to provide thermal insulation and cushioning, but not so thick as to add undesired bulkiness to the garment 10, or create difficulties in manufacturing. In addition, although the filler material 40 generally traps air therein, the matrix of the filler material 40 may have sufficiently large gaps that liquids, such as liquid water, is generally not trapped in the filler material 40 due to capillary or other forces. In addition, the filler material 40 may be made of non-moisture absorbent and/or hydrophobic materials. In this manner the filler material 40 does not trap/absorb moisture, which trapped/absorbed moisture could increase the thermal conductivity of the filler material 40.

The filler material 40 may be made of a mesh or other material with openings or gaps formed therein that are sufficiently large that the filler material 40 is air permeable, water permeable and moisture vapor permeable. The vent 36/opening 38 thus enables relatively large volumes of air to be expelled through the vent 36, thereby enabling moisture vapor-laden air located inside the outer shell 26 of the garment 10 to be exhausted or expelled, such as by natural or force convection. Air positioned within the outer shell 26 of the coat 10 can also be expelled through the vent 36 by various forces, including by the movement of the wearer. For example, natural movements of the wearer, such as lifting, walking, crawling, etc. will cause billowing and deflation of the garment 10, thereby forcing air through the vent 36.

The filler material 40 may also be generally elastic, being elastically stretchable by its construction (e.g. knit arrangement) and/or by the elastic stretching of individual fibers, such as spandex or elastane fibers, which may be blended with generally non-elastic flame resistant fibers. Commercially available spandex fibers include LYCRA® or ELASPAN® sold by Invista North America of North Wichita Kans.; CREORA® sold by Hyosung Corporation or the Republic of Korea; ROICA® and DORLASTAN® sold by Asahi Kasei Fibers Corporation of Japan; LINEL® sold by Fillattice S.P.A. of Monza, Italy; or ESPA™ sold by TOYOBO CO., LTD of Osaka, Japan.

In one case the filler material 40 can be stretched at least about 5% in its length or width direction when stretching forces are applied thereto without breaking or tearing, and return to its original shape when the stretching forces are removed. The filler material 40 thus provides flexibility to the garment 10, particularly along the back panel 18, and even more particularly in the lateral (horizontal) direction across the shoulders/upper back of the garment 10. In this manner, when a wearer leans forward, bends down, raises his or her arms, moves his or her arms forwardly, etc., the filler material 40 is stretched to provide ease of movement to the wearer, without compromising the protection provided by the garment 10. In some cases, the filler material 40 may have a directional stretch property such that the filler material 40 is more elastic in a particular direction (e.g. laterally, in one case; vertically in another) compared to other directions. The filler material 40 can be configured to accommodate horizontal/lateral stretching alone, or lateral stretching in combination with other directions (vertical, diagonal, etc.).

The garment 10 may include a protective flap 42 positioned on the back panel 18 and covering the opening 38/filler material 40. In particular, in the illustrated embodiment the flap 42 is generally hexagonal, and includes an upper edge 44*a*, lower edge 44*b*, upper side edges 44*c*, 44*d* and lower side edges 44*e*, 44*f*. The flap 42 can have a variety of shapes and be made of a variety of materials, but in one case is made of the same materials as the outer shell 26 described above.

The flap 42 is positioned over, and covers, the opening 38/filler material 40 to protect those components from wear and abrasion, to provide thermal protection, and to reduce the penetration of moisture or hazardous materials into the garment 10. The flap 42 may have a footprint/shape/size larger than that of the opening 38/filler material 40 such that the flap 42 extends beyond the opening 38/filler material 40 around the entire perimeter of the opening 38/filler material 40. Thus, the flap 42 may be shaped and positioned such that there is generally no direct path (in a direction perpendicular to the surface of the outer shell 26) from the outside of the garment 10 through the opening 38/filler material 40.

In one embodiment the flap 42 is secured to the back panel 18/outer shell 26 by stitching or the like extending along the upper edge 44*a*, lower edge 44*b* and upper side edges 44*c*, 44*d* (it thus should be understood that FIG. 3, which illustrates part of the flap 42 folded upwardly and not attached along lower edge 44*b*, is provided for illustrative purposes and the flap 42 may not actually be foldable in such a manner after assembly). The lower side edges 44*e*, 44*f* of the flap 42 may not be attached to the back panel 18/outer shell 26 (or at least are not attached along their entire lengths) to provide side vent openings 46 (see FIG. 2*a*) positioned between the back panel 18/outer shell 26 and the flap 42. The side vent openings 46 allow any moisture vapor passing through the opening 38 and filler material 40 to entirely exit the garment 10. The side vent openings 46 are generally vertically oriented in the illustrated embodiment, which helps to reduce/minimize moisture penetration since liquid on the outer surface of outer shell 26 will tend to flow vertically along the back panel 18 due to gravity. Should any moisture penetrate the opening 38/filler material 40, however, the wearer can still be protected due to the presence of the moisture barrier 30.

Figure 4:
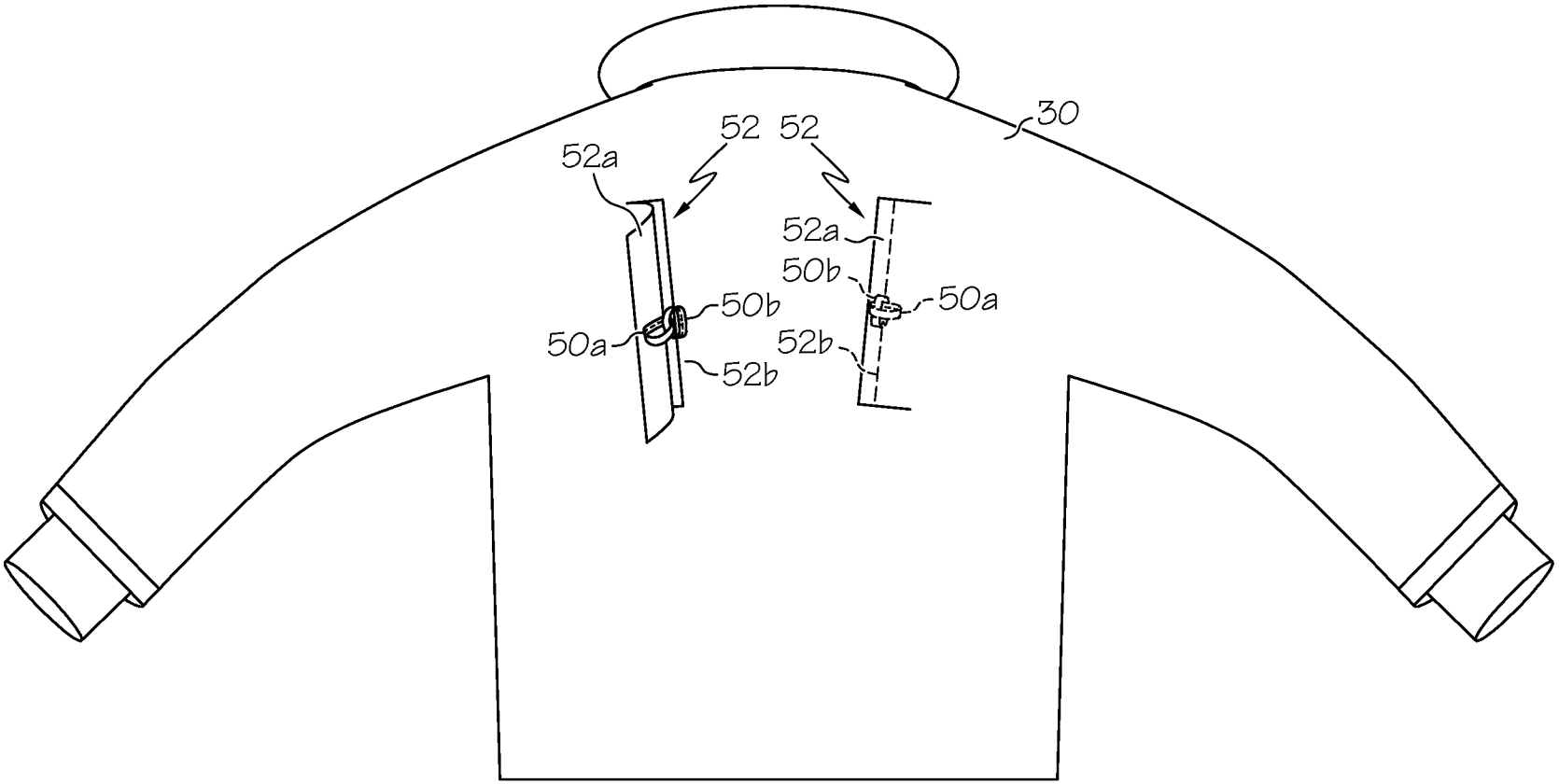
FIG. 4 is a back view of one embodiment of the moisture barrier of the garment of FIG. 1, with part of the vent flap folded outwardly for illustrative purposes.
Figure 5:
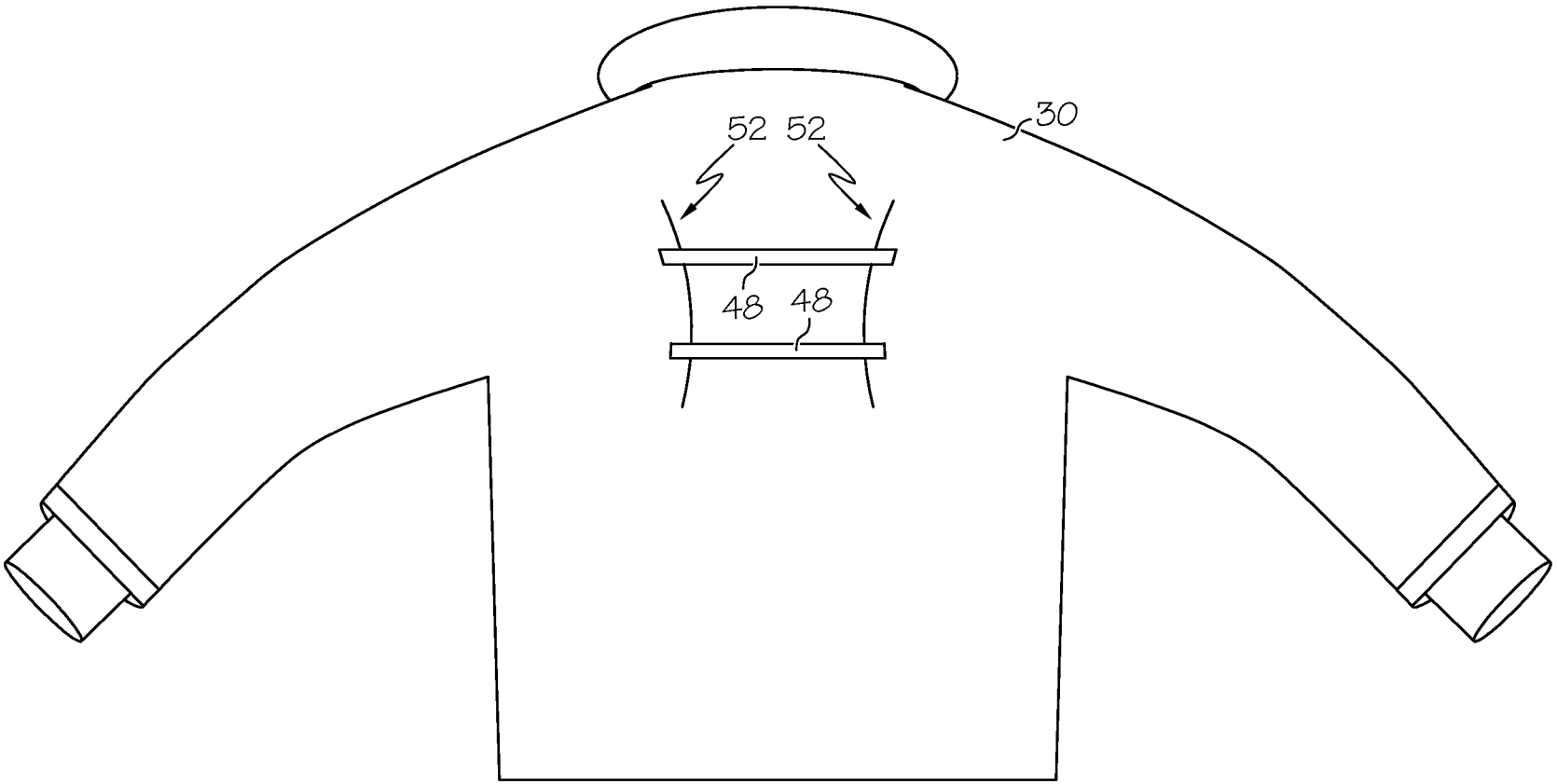
FIG. 5 is a back view of another embodiment of the moisture barrier of the garment of FIG. 1.

As shown in FIGS. 4-7, the moisture barrier 30 may also be vented at various positions. In particular, as shown in FIGS. 4 and 5 in one embodiment the moisture barrier 30 includes a pair of generally vertically extending vents 52 formed by gaps, cuts or openings formed in or through the moisture barrier 30. In one case, the moisture barrier vents 52 are generally aligned with the outer shell vent openings 46 such that any moisture trapped inside the moisture barrier 30 can be vented externally of the garment 10 by the aligned/overlapping vents 46, 52. The overlying/underlying vents 46/52 may be generally aligned, in one case, such that the vertical height of one vent is within about 25%, or about 10%, of the other, and each vent 46/52 may be horizontally spaced from its associated other vent 46/52, if at all, no more than about 25%, or no more than about 10%, of the horizontal width of the garment 10 at that location.

The moisture barrier 30 may include certain features to limit the expansion of the moisture barrier 30/vents 52, and ensure that vents 52 remain generally closed and provide at least some moisture barrier protection at all positions. In particular, as shown in FIG. 4, a loop 50*a* (made of a generally non-elastic material in one case) may be coupled to the underside of an overlapping portion 52*a* of the vent 52, and another loop 50*b* is coupled to the top side of an underlying portion 52*b* of the vent 52. The loops 50*a*, 50*b* are locked/interlooped with each other.

The loops 50 may be configured and positioned have some slack during normal wear (i.e. when the wearer's arms at his/her side). However, when the moisture barrier 30/back panel 18 is sufficiently stretched (i.e. when a wearer reaches forward), the loops 50 may be pulled taut and limit any further expansion/movement of the moisture barrier 30/back panel 18 in the lateral direction. The loops 50 thereby limit the amount by which the moisture barrier 30/vents 52 can be stretched, particularly laterally, to ensure the moisture barrier 30 provides sufficient protection and is not over-expanded, to avoid exposing the open vents 52. The interlocking loops 50 could be replaced with other structure that provides similar features, such as a strap of material coupled directly to the portions 52*a*, 52*b* of the vent 52.

Various other arrangements may be provided to the moisture barrier vents 52. For example, in order to provide some flexibility to the moisture barrier 30, in some cases one or more straps 48 (FIG. 5) may be provided and be coupled to the outer side of each vent 52, extending generally horizontally. Each strap 48 may be made of an elastic or non-elastic material, and placed in tension under normal conditions to pull portions of the moisture barrier 30 into an overlapping condition, as shown in FIG. 5. If the straps 48 are made of an elastic material, the straps 48 may be configured to be further stretched during certain movements by a wearer (i.e. when a wearer reaches forward) to provide some flexibility. The elastic nature of the straps 48 help to ensure that the moisture barrier 30 returns to its original shape once stretching forces are no longer applied. If the straps 48 are made of an elastic material, they may be configured to have a stretch limit to ensure that the moisture barrier 30 is no stretched so far as to expose the vents 52 (i.e. ensure that the vents 52 remain covered by the cover 42). The elastic straps 48 of FIG. 5 may also be used in conjunction with the stretch-limiting feature 50 of FIG. 4, if desired.

Figure 7:
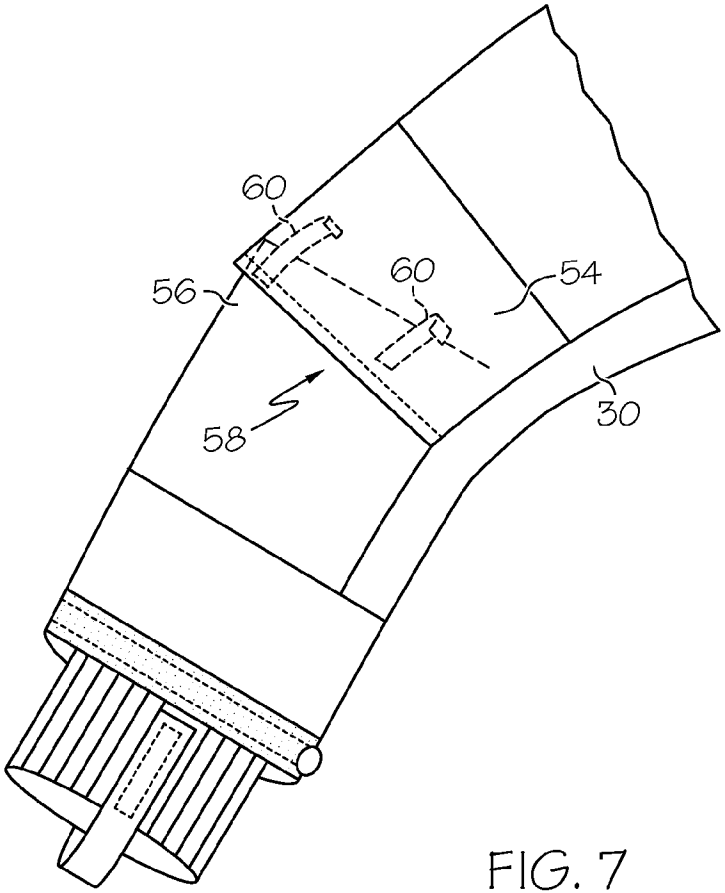
FIG. 7 is a side view of the sleeve of FIG. 6, shown in a differing position.
Figure 6:
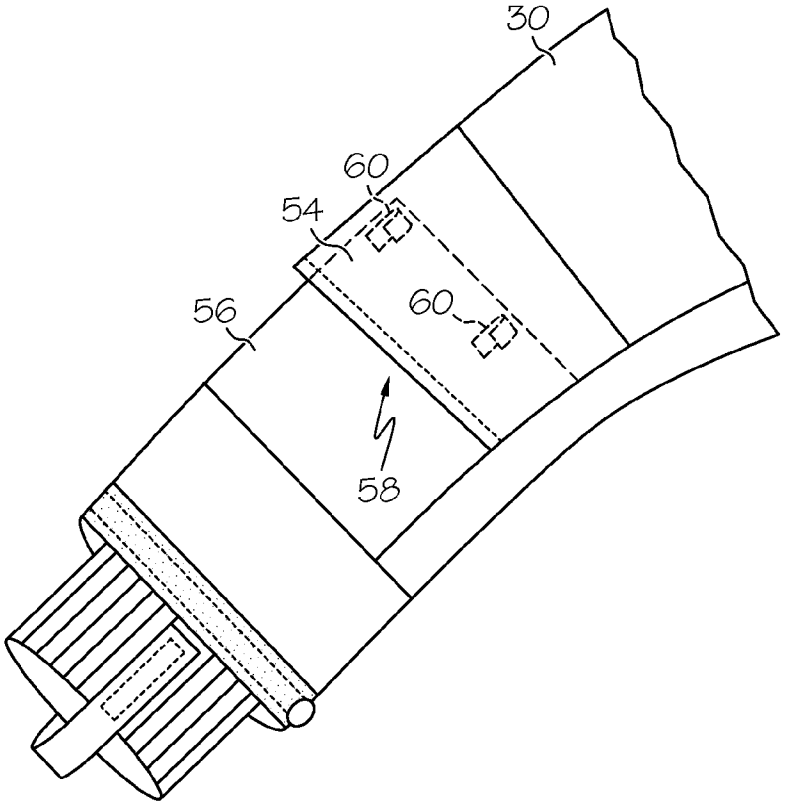
FIG. 6 is a side view of a sleeve of a moisture barrier, showing a venting feature thereof.

The moisture barrier 30 may also provide venting at other locations. For example, FIG. 6 illustrates an upper moisture barrier portion 54 shingled over a lower moisture barrier portion 56, defining a gap or vent 58 therebetween. A pair of straps 60 are positioned in the vent 58 and coupled to the moisture barrier portions 54, 56 to prevent overexpansion of the vent 58. The vent 58 may be positioned on the forearm portion of the moisture barrier 30 of each sleeve 24 and enables moisture-laden air inside the moisture barrier 30 to be quickly expelled, and also provides flexibility and ease of movement. For example, FIG. 7 shows the arm of FIG. 6 pivoted to a slightly different position, thereby further opening the vent 58, and pulling the upper strap 60 nearly taut. This arrangement of the vent 58 provides somewhat of a pivoting joint to the moisture barrier 30, and provides less resistant to such movement than many other garments.

In the illustrated embodiment, the vent 58 is positioned about the upper portions of the sleeve 24 of the garment 10; i.e. extending at least about 180 degrees, or about 270 degrees (of a possible 360 degrees) in one case, and thus may not extend around the entire perimeter of that area of the garment 10/moisture barrier 30. However, the vent 58 can take any of a wide variety of shapes and configurations beyond those specifically shown in the drawings, and located at various positions. For example, such moisture barrier vents can be positioned at various other portions on the torso of the garment (besides the back), such as on the underarm, the top of the shoulder, at the neck, elbow, wrist, waist or other locations. Moisture barrier vents can also be positioned at various positions on a pair of trousers, such as at the front and/or back of the knees, at the ankle, at the crotch, yoke, seat or waist, etc. The vents and other features described herein can also be used in conjunction with garments besides coats, such as trousers (as noted above), jump-suits, vests, etc.

As noted above, in some cases, a vent in the moisture barrier 30, as shown in FIGS. 4 and 5, may be accompanied by an associated vent 36 in the outer shell 26, and possibly also by the filler material 40. Thus, each of the moisture barrier vents described above, such as those shown in FIGS. 6 and 7, may also be used in conjunction with associated vents/filler material in the outer shell 26. Such an arrangement can provide for increase ease of movement and venting. Thus, each of the positions listed above for the vent in the moisture barrier 30 are also positions at which the outer shell 26 can be vented and/or incorporate the filler material 40. However, if desired, the moisture barrier vents may be used without an associated vent/filler material in the outer shell 26, and conversely any vent/filler material in the outer shell 26 may be used without an associated moisture barrier vent.

Having described the invention in detail and by reference to the preferred embodiments, it will be apparent that modifications and variations thereof are possible without departing from the scope of the invention.

What is claimed is:

1. A protective garment comprising:

a heat, flame and abrasion resistant outer shell configured to be worn on at least part of a body of a wearer, wherein the outer shell includes an opening formed therein; and a heat and flame resistant material, of a different type of material than the outer shell, positioned in and spanning the opening, wherein said material is air permeable and positioned in said opening such that air passing through said opening also passes directly through said material.

2. The garment of claim 1 further comprising a moisture barrier configured to be positioned between the outer shell and wearer of the garment, wherein the moisture barrier is generally liquid moisture impermeable and generally moisture vapor permeable.

3. The garment of claim 2 wherein the moisture barrier includes a vent that communicates with the opening.

4. The garment of claim 1 further comprising a protective flap positioned over the opening and the material.

5. The garment of claim 4 wherein the flap entirely covers the opening and the material.

6. The garment of claim 4 wherein the flap and the outer shell define at least one vent that communicates with the opening.

7. The garment of claim 4 wherein the flap and the outer shell define a pair of generally vertically extending side vents that communicate with the opening.

8. The garment of claim 7 wherein the flap is coupled to the outer shell about generally about the entire perimeter of the flap except along the side vents.

9. The garment of claim 4 wherein the garment further includes a moisture barrier configured to be positioned between the outer shell and wearer of the garment, wherein the moisture barrier is generally liquid moisture impermeable and generally moisture vapor permeable, wherein the flap and the outer shell define at least one vent that communicates with the opening, and wherein the moisture barrier includes at least one vent that is generally aligned with the vent defined by the flap and the outer shell.

10. The garment of claim 1 wherein the material is elastic.

11. The garment of claim 10 wherein the material is stretchable at least about 5% in its length or width direction without breaking or tearing when stretching forces are applied thereto, and returns to its original shape when the stretching forces are removed.

12. The garment of claim 1 wherein the material is non-moisture absorbent and is air, liquid, and moisture vapor permeable.

13. The garment of claim 1 wherein the material has a thickness greater than a thickness of the outer shell to provide cushioning to a wearer of the garment.

14. The garment of claim 1 wherein the material has a thickness of at least about ¼".

15. The garment of claim 1 wherein the opening has a surface area of at least about 16 square inches.

16. The garment of claim 1 wherein the material generally entirely fills the opening.

17. The garment of claim 1 wherein the garment is a coat and the opening is positioned on a back of the coat.

18. The garment of claim 1 wherein the material is generally co-planar with the outer shell and lacks any portions that lie on top of, or overlap with, the outer shell.

19. The garment of claim 1 wherein the garment meets National Fire Protection Association ("NFPA") 1971 standards for protective firefighting garments.

20. A protective garment comprising:

an outer shell;

a moisture barrier configured to be positioned between the outer shell and wearer of the garment, wherein the moisture barrier is generally liquid moisture impermeable and generally moisture vapor permeable, wherein the outer shell and the moisture barrier each include a vent, and the vents are generally aligned; and a protective flap positioned over the vent of the outer shell, wherein the flap at least partially defines at least one vent that communicates with the vent of the outer shell.

21. A protective garment comprising:

a protective garment including an outer shell; and a moisture barrier configured to be positioned between the outer shell and wearer of the garment, the moisture barrier including a vent defined by overlapping portions of the garment, wherein the vent is positioned on the sleeve or leg of the garment, wherein the vent extends more than about 180 degrees but less than about 360 degrees around the sleeve or leg.

22. A protective garment comprising:

an outer shell;

a moisture barrier configured to be positioned between the outer shell and wearer of the garment, the moisture barrier including a vent defined by overlapping portions of the moisture barrier; and an expansion limiter configured to allow said vent to be expanded at a position of said expansion limiter but configured to prevent the vent from being expanded to a position wherein the portions of the vent no longer overlap.

23. The garment of claim 1 wherein said material is positioned in said opening such that all air passing through said opening also passes directly through said material.

24. The garment of claim 1 wherein said opening has an outer perimeter, and wherein the material is coupled to said outer perimeter.

25. The garment of claim 1 wherein the opening provides a path into an interior of the outer shell in a direction perpendicular to a plane of the outer shell.

26. A protective garment comprising:

a heat, flame and abrasion resistant outer shell configured to be worn on at least part of a body of a wearer, wherein the outer shell includes an opening formed therein and material positioned in the opening, wherein the opening provides a path into an interior of the outer shell in a direction perpendicular to a plane of the outer shell; and a protective flap positioned over the opening and the material, the flap defining a pair of generally vertically extending side vents that communicate with the opening, wherein the opening has an outer perimeter and the heat and flame resistant material is directly coupled to an entirety of said outer perimeter.

* * * * *